United States Patent [19]

Curry et al.

[11] 4,018,027

[45] Apr. 19, 1977

[54] HEAT INSTALLED MULTI-PACK CARRIER MACHINE

[75] Inventors: Byron V. Curry, Santa Barbara; Teofil L. Bonkowski, Stockton, both of Calif.

[73] Assignee: Byron V. Curry et al., Santa Barbara, Calif.

[22] Filed: June 2, 1975

[21] Appl. No.: 583,183

[52] U.S. Cl. ..... 53/48; 53/141; 53/184 S

[51] Int. Cl.[2] ..... B65B 21/00; B65B 21/24; B65B 27/04

[58] Field of Search ..... 53/184 S, 184 R, 48, 53/49, 185, 30, 329, 141, 3; 206/150, 162

[56] References Cited

UNITED STATES PATENTS

| | | | |
|---|---|---|---|
| 3,032,944 | 5/1962 | Hull et al. | 53/48 |
| 3,044,230 | 7/1962 | Fisher | 53/48 X |
| 3,488,911 | 1/1970 | Poupitch | 53/48 X |
| 3,494,098 | 2/1970 | Sternau | 53/329 |
| 3,621,628 | 3/1970 | Chidsey, Jr. | 53/48 X |
| 3,742,677 | 7/1973 | Best | 53/48 X |

*Primary Examiner*—Othell M. Simpson
*Assistant Examiner*—Horace M. Culver
*Attorney, Agent, or Firm*—James E. Hawes

[57] ABSTRACT

A carrier is disclosed for interconnecting and holding an array of cans or the like together as a unitary package. Preferably the carrier is made from a thermally shrinkable plastic sheet, and is formed to be placed around an array of cans then shrunk by application of heat to interconnect the cans and form the package. A machine is disclosed for performing this packaging operation efficiently and rapidly, the method including the step of preforming the plastic sheets to provide a cylindrical collar about each opening, thereby enhancing the hold and interconnection afforded by the carrier. A cover sheet may be employed with the carrier to keep the can tops clean. The method for performing this packaging operation also is disclosed.

8 Claims, 10 Drawing Figures

HEAT INSTALLED MULTI-PACK CARRIER MACHINE

BACKGROUND OF THE INVENTION

The invention is concerned generally with the art of packaging, and more particularly with a multi-pack carrier for an array of cylindrical containers, such as the common 6-pack beverage can carrier.

As is well known, a wide variety of articles are packaged in containers which are interconnected and sold as a single unit. For example, it has been reported that on the order of 84 billion cans this year will be packaged in units of six, these cans being interconnected by a simple pastic sheet or structure that also serves as their carrier. There are many packages of this general type, representative carriers and packaging machines being disclosed by Poupitch in U.S. Pat. Nos. 2,874,835, 2,929,181 and 2,936,070; by Hull et al. in U.S. Pat. No. 3,032,944; by Fisher in U.S. Pat. No. 3,044,230; and by the applicants in their U.S. Pat. Nos. 3,134,485 and 3,206,019. Many of these carriers and machines are complex. Also, most of them do not protect the tops of the packaged cans from contamination or soiling, nor do they permit a cover sheet to be added for this purpose.

Among the objects of the present invention is the provision of a simple carrier that may be easily applied to an array of cans or the like to securely hold them together as a unit even when handled roughly. This carrier should permit a simple mechanism for applying it to the array of cans, a mechanism adapted to rapid, high-volume, on-line product. The carrier and mechanism also should permit a sheet to be placed over the array during the packaging operation to protect the can tops and maintain them in a clean condition until unpackaged. These and other objects will be apparent from the following description of the invention.

BRIEF DESCRIPTION OF THE INVENTION

The invention provides a carrier that may, in an expanded state, be placed around an array of cans or other elements to be interconnected as a package, then by application of an external force be caused to shrink about the cans to firmly hold them together as a unit. Preferably this carrier is formed from a sheet of an expanded, heat-shrinkable plastic material. It is formed with a plurality of openings, each intended to receive one can. After being placed around an array of cans, the sheet may be heated to shrink about the array and interconnect the cans as a package. To reduce the space required for this packaging operation when applied to a volume packaging system, it is preferred that a plastic sheet be used that has been expanded a small amount in the direction of movement of the packaging line and a larger amount in a direction transverse to movement of the packaging line. The openings in the sheet therefore will be eliptical to, when heated, shrink into a circular form about each of the cans. Preferably the heat is applied uniformly to the marginal areas about the openings to provide collars all oriented in the same direction about the cans.

Contemplated within the scope of the invention is a method of packaging that employs a sheet which may be expanded, openings provided, then placed about a series of elements and shrunk by application of an external force to interconnect the elements as a package. Preferably this sheet is formed of a heat shrinkable plastic material which, after being placed around an array of cans, is shrunk by application of heat.

Also contemplated with the scope of the invention is a machine for packaging cans or the like by employing a sheet that may, in an expanded state, be provided with openings, applied about an array of cans then by application of an external force shrunk to interconnect the cans. Preferably this sheet is formed of a heat shrinkable plastic material that is shrunk about the cans by application of heat within the machine. This sheet may be a continuous sheet that is applied to a continuous array of cans then, after interconnecting the cans, cut by a mechanism within the machine into separate packages. Also, a cover sheet may be provided within the machine and placed over the tops of the array of cans prior to the carrier sheet being applied, the carrier serving to hold this cover sheet about the top of each of the cans thereby sealing it against contamination until the package is opened.

BRIEF DESCRIPTION OF THE DRAWINGS

The invention will be further described in connection with the accompanying drawings in which.

DETAILED DESCRIPTION OF THE INVENTION

A preferred application of the invention is to interconnect an array of six cans as a single, unitary package. Of course, the invention is of much broader application than this and, for example, can be used to interconnect an array of almost any number of elements, each element having any of various different shapes. In addition, while it is preferred to use a shrinkable plastic to interconnect these cans, other materials exist and may be developed which will satisfactorily perform as the sheet material of the carrier in accordance with the principals set forth herein. Accordingly, while these and other preferred elements and applications of the invention are set forth in the following detailed description, the invention is not so limited either in concept or in application.

Figure 1:
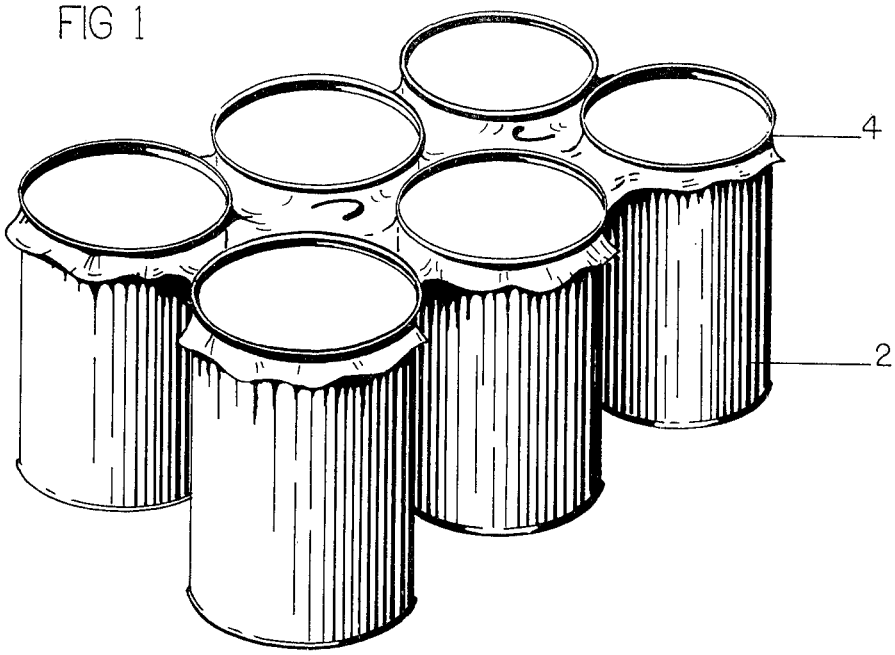
FIG. 1 is a perspective view of an array of cans interconnected by a carrier formed in accordance with the present invention.

In FIG. 1 an array of six cans 2 are shown interconnected by a carrier 4. This carrier is positioned about the upper end of each can and has an opening which receives each can, the carrier forming a collar about each received can. This collar bears upon the can, holds the can, and interconnects the array as a unitary package. Because of the many cans packaged in such a fashion as this, such a package probably is quite familiar in appearance. It also is deceptively simple. Since the top rim of any ordinary can is larger than its body, an opening must be provided in the carrier that is large enough to permit the top rim of the can to pass through it. This opening then must somehow be reduced in size to cause the margin area surrounding it to firmly grasp the can, interconnecting the array as a package. Obviously, the requirement that the size of the opening in the carrier be large enough to pass over the top rim of the can conflicts with the requirement that the margin area about the opening firmly grasp the can. This conflict in requirements has challenged the ingenuity of packaging engineers for decades.

Figure 2:
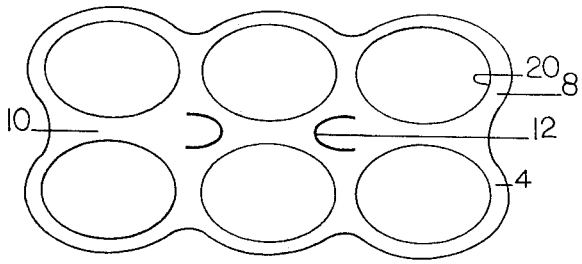
FIG. 2 is a plan view of a preferred carrier.

In FIG. 2 is shown a carrier 4 formed in accordance with the principals of the invention. This carrier, preferably is cut from a sheet of an expanded plastic material, such as polyvinyl chloride, a material which upon application of heat will contract appreciably. Such plastic sheet materials are quite common and may be formed from many different plastics to contract an amount that may be predetermined over a wide range. The contraction of such a biaxially oriented film may be adjusted to be different in different directions of the sheet. For example, commonly such a sheet material is extruded as a cylinder then, as it cools, stretched both longitudinally and transversely a given amount. At a later point this sheet may be heated to contract approximately by the amount it was stretched, the contraction in each direction being proportional to the stretch imparted in that direction.

For reasons that will be stated during the discussion of a preferred machine constructed in accordance with the principals of this invention, it is preferred that such a plastic sheet material be employed as a carrier that has been stretched approximately 10 percent in one direction, termed the longitudinal direction, and 30 percent in the other direction, termed the transverse direction. However, films shrinking by as much as 65 percent have been employed successfully.

Other plastic materials than polyvinyl chloride (PVC) may be employed, polythylene (PE) having performed satisfactorily as a carrier. While it is cheaper at present than PVC, a PE film tends to be more flexible, relax more readily, and slip more easily than a PVC film of the same thickness. Accordingly, more PE is required to provide a suitable carrier, negating its present cost advantage. A typical PVC heat shrinkable film having an initial thickness on the order of 0.00X inches is quite satisfactory.

If a circular opening were provided in such a sheet material, upon being heated it would contract and the circular opening could distort into an eliptical shape simply because the contraction of the sheet in different directions would be different. Since it is preferred to provide a carrier for circular cans, the carrier 4 is cut to provide a series of six eliptical openings 6. If circular openings nevertheless were provided, while the resultant carrier may function quite satisfactorily the band surrounding each can would tend to vary in width and thickness due to the differential shrinkage and be weaker in some areas than others. A margin area 8 is provided about each opening 6, the carrier 4 including a central area 10 interconnecting the margin areas 8 about the six openings. Two crescent shaped openings 12 are cut into this central area 10 of the carrier to provide the ordinary finger holes for manually grasping the array of cans that are interconnected by the carrier. Other openings may be provided for hanging or displaying the package if desired.

Figure 3:
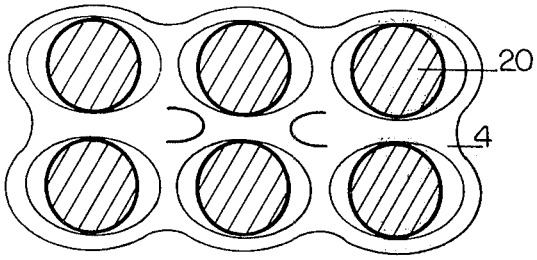
FIG. 3 is a plan view of the preferred carrier placed about an array of cans to be interconnected as a package.
Figure 4:
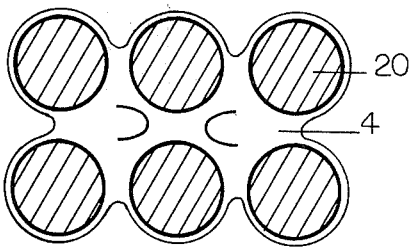
FIG. 4 is a plan view of the cans shown in FIG. 3 after being interconnected by the carrier as a package.

FIG. 3 illustrates this carrier 4 placed, as by hand, about an array of six cans 20. Preferably the carrier is positioned about the top or end portion of each can, slightly underlining the normal bead which results from the connection of the top of the can to the side wall of the can. Heat then is applied preferably in a uniform fashion to one face of the carrier from below the array of cans. This heat causes the plastic sheet material of the carrier to shrink, reducing the size of each opening 6 and causing the collar areas 8 to turn towards the source of heat. The size of the eliptical openings 6 is such, in relation to the size of the cans to be packaged, that upon application of heat the plastic material shrinks about each can to firmly grasp it, the margin areas 8 turning down to provide a collar about the top end of each can as shown in FIG. 1. In this simple fashion, the array of cans are interconnected by the carrier as a unitary package. The top view of this package is shown in FIG. 4.

The heat to shrink the carrier may be applied using any convenient source, such as an infra-red lamp, hot air, or steam. Tests indicate that directing a flow of steam onto the carrier results in a uniform, controlled shrinkage, possibly because such a heat source can be well controlled both in temperature and pressure flow characteristics. For this reason, it is preferred.

Figure 5:
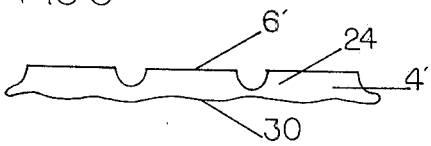
FIG. 5 is a view in elevation of another preferred, pre-formed carrier of the invention.

For various reasons, including positive control of the shape of the plastic sheet and to minimize the shrinkage required to form the package and thus the time required to form the package, for at least some applications it is preferable to pre-form the carrier shown in FIG. 2 to first provide a series of collar areas 24. This preforming result in a carrier such as shown in FIG. 5. The collar areas 24 conveniently may be formed by, for example, placing the carrier over a heated male mold, the mold being shaped to turn the margin area about each opening outward to form a collar. The carrier then is cooled, as by cooling the mold, to set the carrier in this partially contracted shape. Beginning with, for example, a PVC film of 0.00X inches thickness, expanded about 30 percent in one direction and 5–10 percent in the other direction, the preforming operation may shrink the carrier to a thickness of 0.00Y inches and form a collar just large enough to conveniently fit about one of the cans to be packaged. It will be noted that when so formed the carrier 4′ tends to have a clean, sharply defined margin about each opening 6′. However, the lower edge or shoulder area 30 about each collar tends to be slightly ruffled, apparently due at least in part to the slight differences in contraction of the plastic sheet material during the pre-forming operation.

Figure 6:
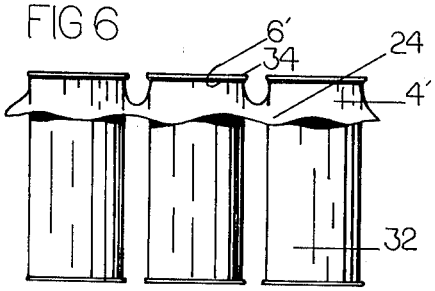
FIG. 6 is a view in elevation of the top portion of a series of cans interconnected by the pre-formed carrier.

As shown in FIG. 6 such a pre-formed carrier may be placed around an array of cans 32 with each opening 6′ underlying the normal bead 34 at the top of each can. While held in this position, the carrier may be further shrunk by application of heat to cause the collars 24 to firmly grip the top margin of each can in the area underlying the bead. This will interconnect the array of cans as a package resulting in a structure such as shown in FIG. 6. The bearing of the edge under the bead best resists the normal downward force tending to free the cans as the resultant package is being carried.

Figure 7:
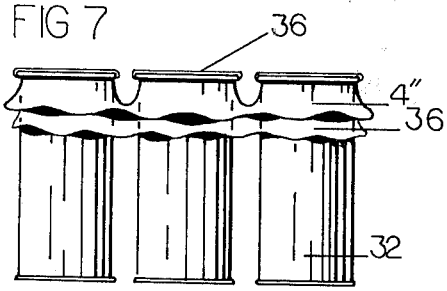
FIG. 7 is a view in elevation similar to FIG. 6 with a cover sheet held about the tops of the cans by the pre-formed carrier.

It is important in a significant number of applications to be able to keep the top of each can in the package clean from the time it is packaged to the time the package is opened. As shown in FIG. 7, the carrier of this invention easily permits such an important result to be achieved. For this, a thin sheet of plastic material 36 first may be placed over the tops of the array of cans, then the carrier 4'' positioned about the cans, the collar areas pulling the thin cover sheet of plastic tight about the top of each can. Heat is applied to shrink the collars of the carrier about the cans, the collars now not only grasping each can firmly and interconnecting them as a package, but also causing the cover sheet material 36 to protect the top of each can. Of course, the thermoplastic characteristics of the sheet material 36 should be such as to not substantially deform upon application of the heat required to shrink the carrier about the cans. There are a variety of plastic and other materials with such characteristics, the material being selected depending both upon the preferences of the packager and upon the characteristics of the material employed as the carrier. Of course, advertising or other information may be imprinted upon this cover sheet and upon the carrier as well to further assist in marketing of the packaged product.

Figure 8:
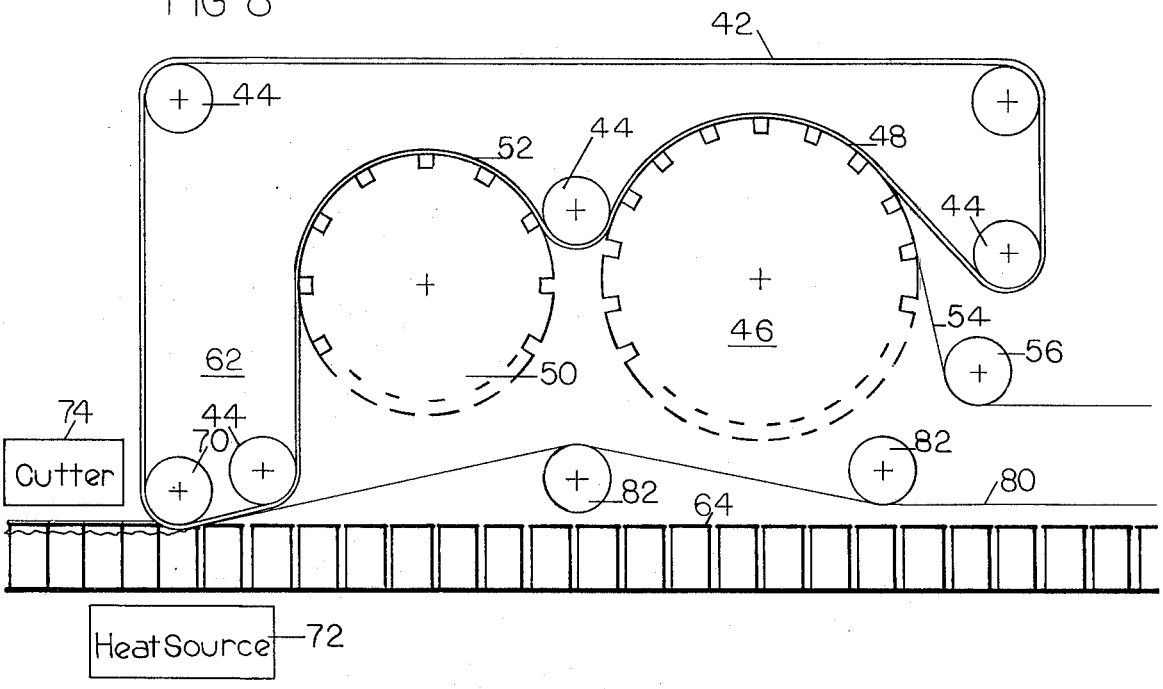
FIG. 8 is a plan view of the major elements of a machine for packaging a series of cans on a conveyor employing a preferred form of the carrier to interconnect and package the cans in arrays of six.

An important feature of the present invention is its adaptability to high volume packaging applications with amazingly simple machinery. An example of such a machine is shown in FIG. 8. It includes a belt 42 of unique characteristics, the belt passing over a series of idler pulleys 44, about a portion of the periphery of a heated drum 46 bearing a series of shaped elements 48 on its periphery, and then about a cooled drum 50 also bearing a series of shaped elements 52 on its periphery. A continuous web 54 consisting of an endless series of pre-cut carriers preferably shaped as shown in FIG. 2 and formed from a heat shrinkable plastic sheet material. It is fed about an idler pulley 56 and into the bite between the belt 42 and drum 46. As this pre-cut web 54 is brought into contact with drum 46 by belt 42, it is pressed about the heated elements 48 carried on the periphery of the drum.

Figure 9:
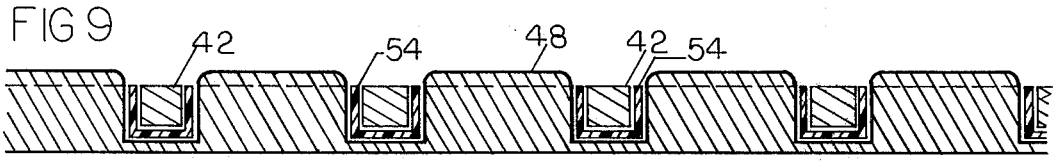
FIG. 9 is a cross-sectional view of a portion of the machine shown in FIG. 8; and, FIG. 10 is a view in cross-section of another portion of the machine shown in FIG. 8.

A developed view of a portion of drum 46 is shown in FIG. 9. The belt 42 is formed and shaped to press the plastic web 54 into engagement with the heated elements 48 about the periphery of the heated drum 46. The temperature and duration of the heat applied by the drum to the web is sufficient to cause the web to partially contract about the elements 48 and to be shaped into a form generally as shown in FIG. 5. The web leaves drum 46, passes around idler roller 44 (the shape of the collars formed in the web by the heated drum being preserved by the belt) and to the cooling drum 50 where the partially contracted shape of the web is set and stabilized by elements 52 similar to elements 48. The web then is carried by the belt down about an idler roller and to an application or packaging station 62 where it is applied to an array of cans 64 on a conveyor belt 66 moving in the direction indicated by arrow 68 in FIG. 8.

Figure 10:
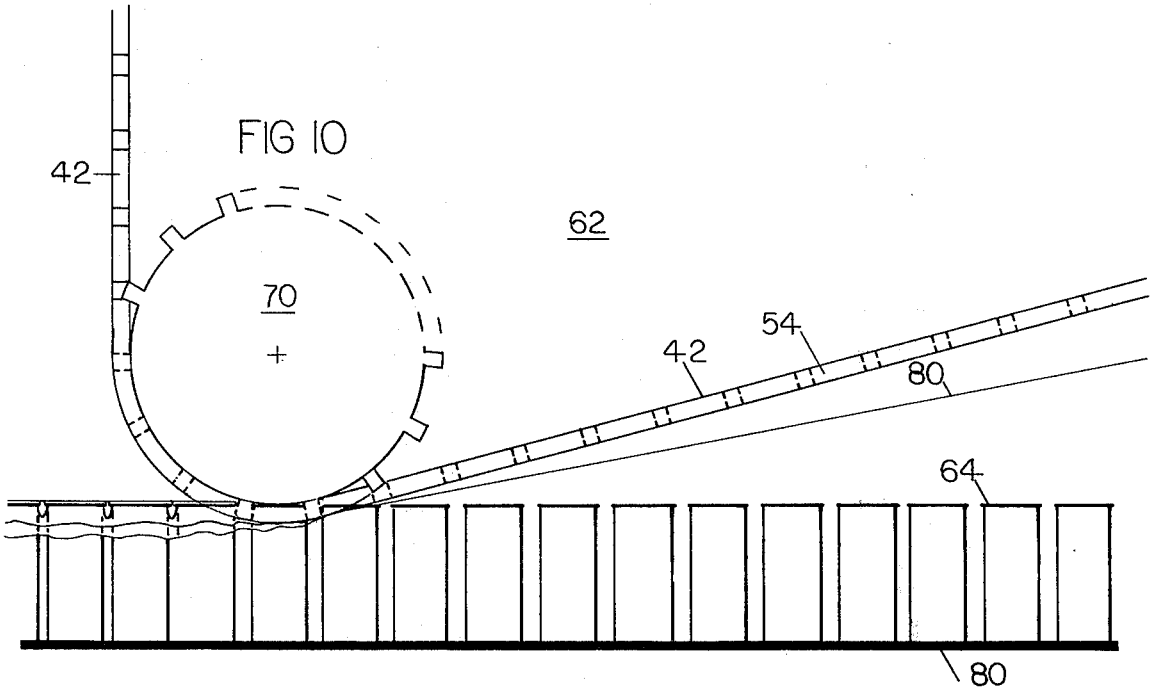

Details of the application station 62 are illustrated in FIG. 10. It includes an application drum 70 that deflects the belt down past the tops of the array of cans passing along the conveyor. While held in this deflected position, a heat source 72 under the conveyor applies heat to the belt and to the web it carries sufficient to cause the plastic sheet material of the web to contract about the tops of the cans. The belt then separates from the web and array of cans, passing upwardly around drum 70 while the cans now interconnected by the web pass to the left as the conveyor moves along.

The finger holes pre-cut in the web 54 may interlock with projections in the various drums 46, 50 and 70 to assist in synchronizing their motions. When the web has been heated sufficiently to interconnect the array of cans, it is allowed to cool then cut by a conventional cutter at cutting station 74 (FIG. 8). This results in a series of packages each consisting of an array of cans interconnected by a carrier formed by a segment of the web material.

Belt 42, and indeed most of the elements of the machine, may take any of various forms, For example, the belt 42 may be formed of a thick, flexible material such as rubber, or it may be formed of a series of metallic or rigid elements interconnected on each side by a chain or the like. Since such metallic elements will best conduct heat and are quite durable, they may be preferred for many applications.

It is estimated that such a machine will produce on the order of 5,000 6-packs per hour, packaging 30,000 cans per hour and taking approximately ¾ of a second to form each successive package. Obviously, this is an appreciable volume of cans. Should the plastic web material forming the carrier shrink a considerable amount during application of heat at packaging station 62, not only will the cans tend to be tipped during this shrinkage but also the space requirements will be substantial. For this reason, it is preferred that shrinkage of the web, at least in the direction of motion of the conveyor, be a minimum amount, the web being shaped by heated drum 46 and cooling drum 50 to provide a collar slightly larger than the top of the cans being packaged. Thus, minimum shrinkage produced by the heat generated by source 72 is required to interconnect the cans and produce the packages. This in turn will result in minimum tippage of the cans and a minimum amount of time required for the operation, thereby minimizing the space requirements for the packaging station.

If it is desired to cover the tops of the cans being packaged, as shown in FIG. 8 a protective film 80 may be provided, passing over idler rollers 82 and into the bite between belt 42 and can tops at packaging station 62, the belt forcing the film over the can tops and the web securing the film about each can top as it contracts as has previously been described in connection with FIG. 7.

While preferred embodiments of the invention have been described, variations will occur to those skilled in this art. Accordingly, the scope of the invention is defined by the following claims.

We claim:

1. A machine for packaging an array of elements with a shrinkable sheet material in which the shrinkable sheet material is formed as a sheet having a multiplicity of openings, one for each element intended to be interconnected as a package, the machine including:

means to pre-form said shrinkable sheet material about said openings into a shape closely approximating but larger than the shape said material will assume on interconnecting said elements, means for applying said shrinkable, pre-formed sheet material about an array of said elements, means for shrinking said material by application of an external force after the material is applied about the array of elements to interconnect the elements into a package, and means for directing a sheet of said material in sequence to said pre-forming means then to said applying means.

2. A machine as set forth in claim 1 in which said shrinkable material is a heat shrinkable plastic material, said means for shrinking said material applying heat to said material while about said elements.

3. A machine as set forth in claim 2 in which said heat shrinkable material is in the form of an endless web.

4. A machine as set forth in claim 3 in which the preforming means include elements to pre-shape said openings in the sheet material web.

5. A machine as set forth in claim 4 for packaging an array of cans carried along a moving conveyor belt, said endless web having openings and being preformed to provide collars intended to mesh with the array of cans carried along the conveyor, the machine including means for cutting the web after it has interconnected said cans into a sequence of packages.

6. A machine as set forth in claim 5 in which said preforming means includes a heated drum bearing said elements about its periphery shaped to intermesh with the openings in the web and to cause the margin area about each opening to be formed into a collar as the web shrinks, the drum being heated sufficiently to produce sufficient shrinkage to form said collars in said web as the web passes about said drum, the preforming means further including a cooling drum to which the web is directed by said directing means after passing about said heated drum, the cooling drum including elements to intermesh with said openings in said web, said elements being cooled sufficiently to set the collar shapes in said web as it passes about the cooling drum, the web then passing to said applying means.

7. A machine as set forth in claim 5 further including means for applying a protective cover sheet over said can tops, said sheet material being held about said can tops by underlying the collars in said sheet heat shrunk about the cans.

8. A machine as set forth in claim 6 in which said directing means includes an endless belt shaped to intermesh with said elements about said heated drum and cooling drum.

* * * * *